US007721907B2

(12) United States Patent
Keung

(10) Patent No.: US 7,721,907 B2
(45) Date of Patent: May 25, 2010

(54) CHILD-RESISTANT FLIP-TOP DISPENSING CLOSURE AND PACKAGE

(75) Inventor: Wing-Kwong Keung, Perrysburg, OH (US)

(73) Assignee: Rexam Closure Systems Inc., Perrysburg, OH (US)

( * ) Notice: Subject to any disclaimer, the term of this patent is extended or adjusted under 35 U.S.C. 154(b) by 1219 days.

(21) Appl. No.: 11/285,597

(22) Filed: Nov. 22, 2005

(65) Prior Publication Data

US 2007/0125741 A1 Jun. 7, 2007

(51) Int. Cl.
*B65D 45/16* (2006.01)

(52) U.S. Cl. ..... 220/324; 215/206; 215/216; 215/218; 215/235; 215/237; 220/254.3; 220/259.2; 222/556

(58) Field of Classification Search ..... 215/237, 215/330, 331, 206, 216, 218, 220, 235; 220/254.3, 220/259.2, 324; 222/556
See application file for complete search history.

(56) References Cited

U.S. PATENT DOCUMENTS

| | | | |
|---|---|---|---|
| 3,902,628 | A | 9/1975 | Schurman |
| 4,005,800 | A | 2/1977 | Schurman |
| 4,022,352 | A | 5/1977 | Pehr |
| 4,154,353 | A | 5/1979 | Hoo |
| 4,170,315 | A | 10/1979 | Dubach et al. |
| 4,787,526 | A | 11/1988 | Pehr |
| 4,925,041 | A | 5/1990 | Pehr |
| 5,031,784 | A | 7/1991 | Wright |
| 5,137,260 | A | 8/1992 | Pehr |
| 5,579,957 | A | 12/1996 | Gentile et al. |
| 5,853,093 | A | 12/1998 | Neiger |
| 5,875,907 | A | 3/1999 | Lay |
| 6,220,637 | B1 | 4/2001 | Kierl |
| 6,269,986 | B1 | 8/2001 | Gross |
| 6,484,895 | B2 | 11/2002 | Montgomery et al. |
| 6,772,902 | B1 | 8/2004 | White |
| 2005/0023285 | A1 | 2/2005 | Keung |
| 2006/0186077 | A1 * | 8/2006 | Robinson ..... 215/237 |

FOREIGN PATENT DOCUMENTS

| | | |
|---|---|---|
| JP | 2003-104429 | 4/2003 |

* cited by examiner

*Primary Examiner*—Anthony Stashick
*Assistant Examiner*—Elizabeth Volz
(74) *Attorney, Agent, or Firm*—Reising Ethington PC

(57) ABSTRACT

A child-resistant closure includes a base, and a lid integrally molded and coupled to the base by a hinge. The lid has a latch arm resiliently extending from a periphery opposite the hinge and having oppositely extending tabs adjacent to a free end of the latch arm. The base has an external recess for receiving the latch arm and spaced ledges in the recess for engagement by the tabs to lock the lid in a closed position. The latch arm is engageable by a user to pivot the latch arm radially inwardly within the passage and release the tabs from the ledges so the lid can be pivoted toward an open position. The tabs and the ledges are recessed radially inwardly from the outer surface of the latch arm in the closed position of the lid with the tabs engaged beneath the ledges.

22 Claims, 4 Drawing Sheets

CHILD-RESISTANT FLIP-TOP DISPENSING CLOSURE AND PACKAGE

The present disclosure is directed to hinged flip-top dispensing closures and packages, and more particularly to provision of a child-resistance feature on such a closure and package.

BACKGROUND AND SUMMARY OF THE DISCLOSURE

U.S. Pat. Nos. 4,638,916 and 5,489,035 disclose dispensing closures of one-piece integrally molded plastic construction. These closures include a base with a dispensing opening and an internally threaded skirt for securement to a container neck finish. A lid is integrally connected by a hinge to a periphery of the base. U.S. Patent document 2005/0023285A1 discloses a child-risistant dispensing closure that includes a base having a deck with a dispensing opening and a peripheral skirt. A lid is integrally molded with the base and coupled by a hinge to a periphery of the base so as to be pivotable between closed and open positions. One of the lid and the base has a latch arm resiliently extending from its periphery opposite the hinge. The latch arm has a pair of oppositely extending tabs adjacent to a free end of the arm. The other of the base and the lid has an axial passage for receiving the latch arm, and a pair of laterally spaced ledges in the passage for engagement by the tabs to lock the lid in the closed position. The latch arm is directly manually engageable by a user from a radial direction external to the closure to pivot the latch arm radially inwardly within the passage and release the tabs from the ledges so that the lid can be pivoted toward the open position.

The present disclosure embodies a number of aspects that can be implemented separately from or in combination with each other.

A child-resistant closure in accordance with one aspect of the present disclosure includes a base and a lid molded integrally with the base. The lid is coupled by a hinge to the base to be pivotable between a closed position and an open position. One of the base and the lid has a latch arm resiliently extending from a periphery opposite the hinge. The latch arm has a pair of oppositely extending tabs adjacent to a free end of the latch arm. The other of the base and the lid has an external recess for receiving the latch arm and a pair of laterally spaced ledges in the recess for engagement by the tabs to lock the lid in the closed position. The latch arm in the recess is directly manually engageable by a user from a radial direction external to the closure to pivot the latch arm radially inwardly within the passage and release the tabs from the ledges so that the lid can be pivoted toward the open position. The tabs on the latch arm and the ledges in the recess are recessed radially inwardly from the outer surface of the latch arm in the closed position of the lid with the tabs engaged beneath the ledges. In this way, the latch arm can be pushed radially inwardly to release the lid without the user's fingers touching the ledges in the recess.

The latch arm preferably is coupled to the lid by a hinge strap having a width that is less than the width of the latch arm adjacent to the lid. This hinge strap absorbs the flexure when the arm is pushed inwardly so that the remainder of the lid is undistorted. Internal reinforcing ribs preferably are provided on the skirt of the lid, to which the hinge strap is coupled, further to protect the lid from distortion when the latch arm is pushed radially inwardly. The outer surface of the latch arm preferably forms a smooth continuation of the outer surface of the lid to eliminate any abrupt change in surface contour that a user's finger may contact. The latch system preferably is positioned adjacent to the bottom of the closure sidewall so that the bottom of the latch arm is protected by a shoulder on the container.

BRIEF DESCRIPTION OF THE DRAWINGS

The disclosure, together with additional objects, features, advantages and aspects thereof, will best be understood from the following description, the appended claims and the accompanying drawings, in which:

DETAILED DESCRIPTION OF PREFERRED EMBODIMENTS

Figure 1:
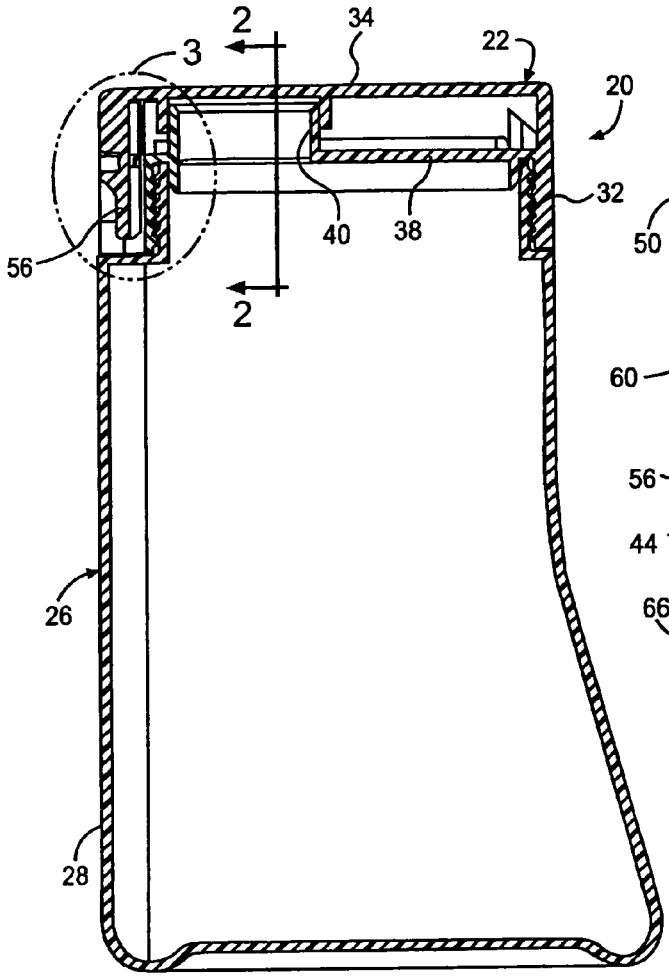
FIG. 1 a sectional view laterally bisecting a child-resistant package in accordance with an exemplary embodiment of the present disclosure.

The disclosure of U.S. Patent document 2005/0023285A1 is incorporated herein by reference.

FIGS. 1-5 illustrate a dispensing package 20 in accordance with an exemplary embodiment of the disclosure as including a closure 22 applied to the neck finish 24 of a container 26. Closure 22 preferably, although not necessarily, is non-removably and non-rotatably mounted on neck finish 24, as disclosed in copending U.S. application Ser. No. 11/285,245. Container 26 includes a body 28 from which neck finish 24 integrally extends. Container body 28 and neck finish 24 preferably are of one-piece integrally molded plastic construction, although neck finish 24 could be molded separately from body 28 and attached to body 28 in a post-molding operation. As another exemplary alternative, neck finish 24 could be insert molded to body 28 or vice versa. Container body 28 can be of any suitable geometry, with the geometry shown in the drawings being by way of example only. Engagement elements 30 (FIG. 3) are provided on the external surface of neck finish 24 for engagement by closure 22 to secure the closure to the container neck finish. Container body 28 and neck finish 24 can be formed in any suitable molding operation of any suitable material, such a polypropylene for example.

Closure 22 (FIGS. 6-12) is of one-piece integrally molded plastic construction including a base 32 pivotally connected to a lid 34 by a hinge 36. The exemplary hinge 36 illustrated in the drawings is of the type disclosed in U.S. Pat. No.

6,041,477, although any suitable hinge can be employed. Base 32 has a deck 38 with a dispensing opening 40 and a skirt 42 extending from deck 38. Deck 38 can be flat as shown, domed, slanted or of any suitable geometry. Likewise, dispensing opening 40 can be round as shown or of any other suitable geometry. Internal engagement elements 44 (FIGS. 3 and 7) are provided on skirt 42 for engagement with external engagement elements 30 on neck finish 24 to secure closure 22 to container 26. External engagement elements 30 may comprise ratchet pawls and internal engagement elements 44 may comprise rounded beads, as illustrated in the drawings and described in the above-noted copending application, to facilitate non-removable application of the closure to the container. Other suitable removable or non-removable engagement elements, including mating threads, can be employed. Skirt 42 and neck finish 24 are non-circular in the exemplary embodiment of the disclosure so that closure 22 is non-rotatable on container 26 as previously described. A laterally and axially opening external passage or recess 46 in base 32 opposite hinge 36 has a pair of laterally opposed ledges 48.

Lid 34 preferably has a peripheral skirt 50. Peripheral skirt 50 preferably has a continuous or segmented internal bead 52 (FIGS. 4 and 7) that cooperates with a continuous or segmented external bead 54 on base deck 38 for releasable snap retention of lid 34 in the closed position of FIGS. 1-5. A latch arm 56 extends from skirt 50 opposite hinge 36. Latch arm 56 has a pair of laterally extending tabs 58 that are releasably received beneath ledges 48 of deck recess 46 in the closed and latched position of lid 34 illustrated in FIGS. 1-5. To open lid 34, latch arm 56 is manually engaged by a user and pushed radially inwardly until tabs 58 clear ledges 48. At this point, latch arm 56 and lid 34 can be moved upwardly toward the open position, with latch arm tabs 58 passing behind or radially inwardly of ledges 48 in recess 46. Closure 22 may be of any suitable molded plastic construction, such as polypropylene for example.

As best seen in FIGS. 5, 7, 9 and 12, latch arm 56 is integrally connected to skirt 50 of lid 34 by a hinge strap 60. Hinge strap 60 preferably has a lesser width 61 (FIG. 5) than the width 63 of latch arm 56 adjacent to skirt 50. Hinge strap 60 thus is more flexible than latch arm 56 or skirt 50, and helps isolate skirt 50 from bending and distortion when latch arm 56 is moved radially inwardly to unlatch the lid. Further to reduce or prevent distortion of skirt 50, at least one internal rib 62, and preferably a pair of internal ribs 62 on laterally opposed sides of hinge strap 60, may be provided on skirt 50. Ribs 62 preferably integrally extend from the base 64 of lid 34 to the edge of skirt 50 remote from base 64.

Figure 3:
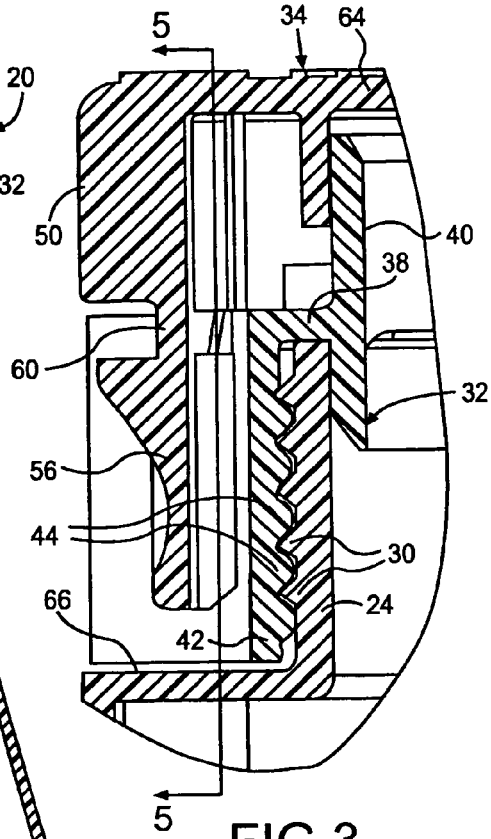
FIG. 3 is a fragmentary sectional view on an enlarged scale of the portion of FIG. 1 within the area 3.
Figure 2:
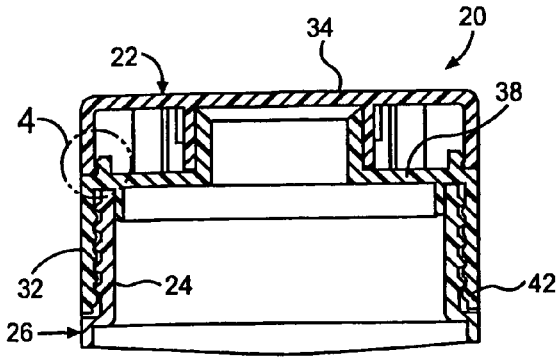
FIG. 2 is a fragmentary sectional view taken substantially along the line 2-2 in FIG. 1.
Figure 4:
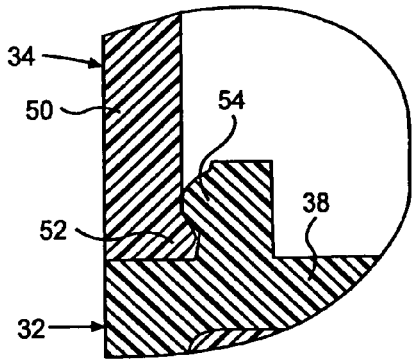
FIG. 4 is a fragmentary sectional view on an enlarged scale of the portion of FIG. 2 within the area 4.
Figure 5:
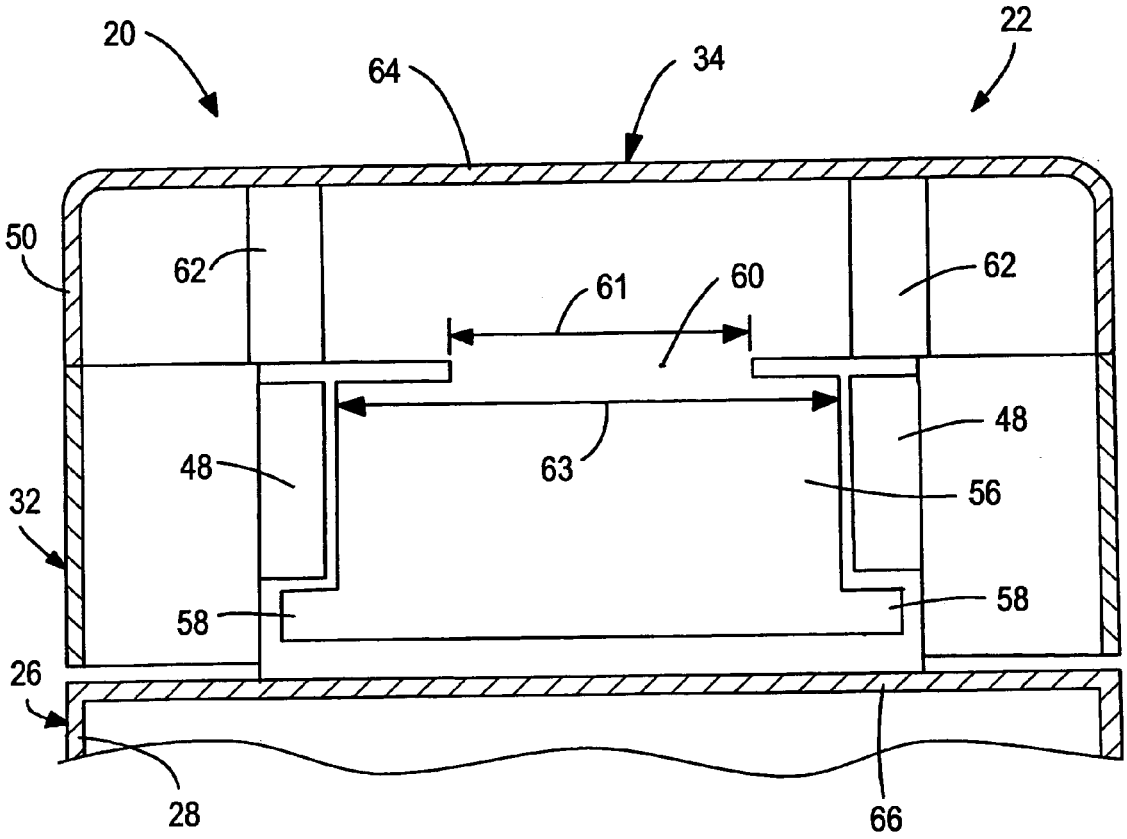
FIG. 5 is a fragmentary sectional view taken substantially along the line 5-5 in FIG. 3.
Figure 6:
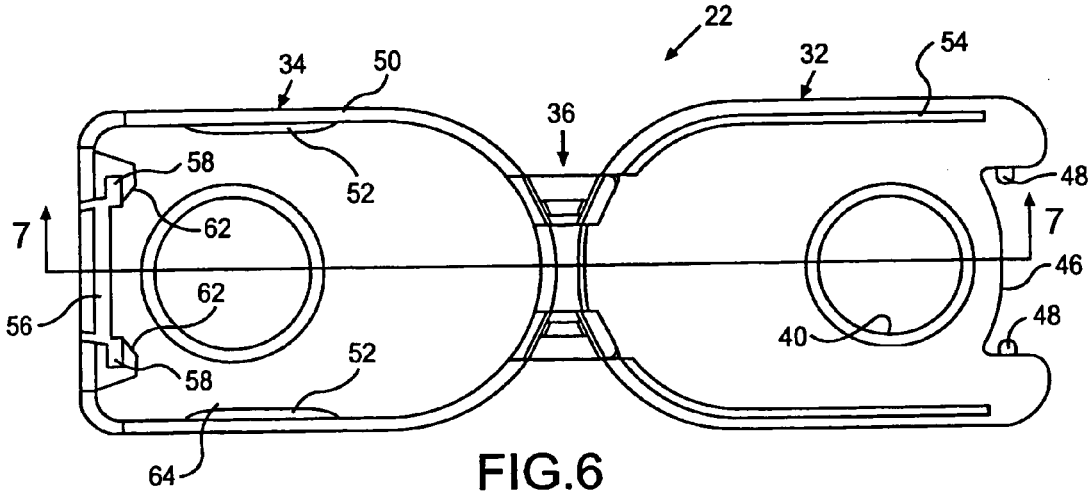
FIG. 6 is a top plan view of the closure in FIG. 1 in the open position as molded.
Figure 7:
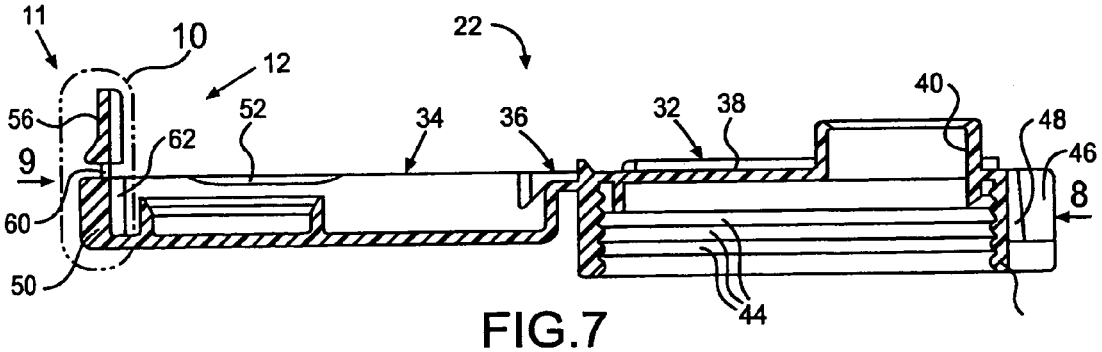
FIG. 7 is a sectional view taken substantially along the line 7-7 in FIG. 6.
Figure 8:
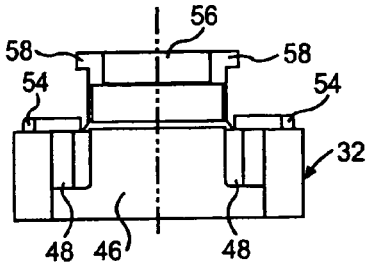
FIG. 8 is a side elevational view taken from the direction 8 in FIG. 7.
Figure 9:
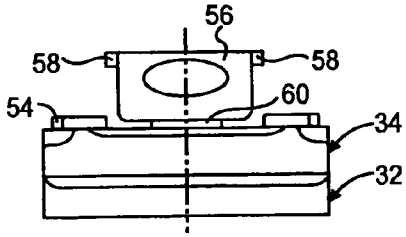
FIG. 9 is a side elevational view taken from the direction 9 in FIG. 7.
Figure 10:
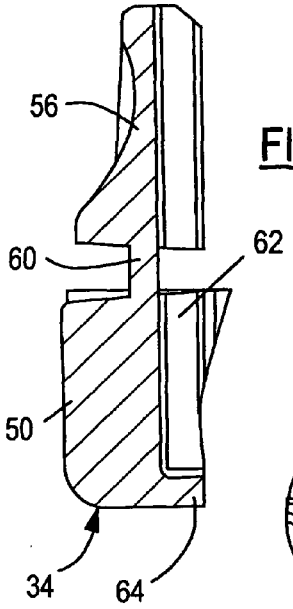
FIG. 10 is a fragmentary sectional view on an enlarged scale of the portion of FIG. 7 within the area 10.
Figure 11:
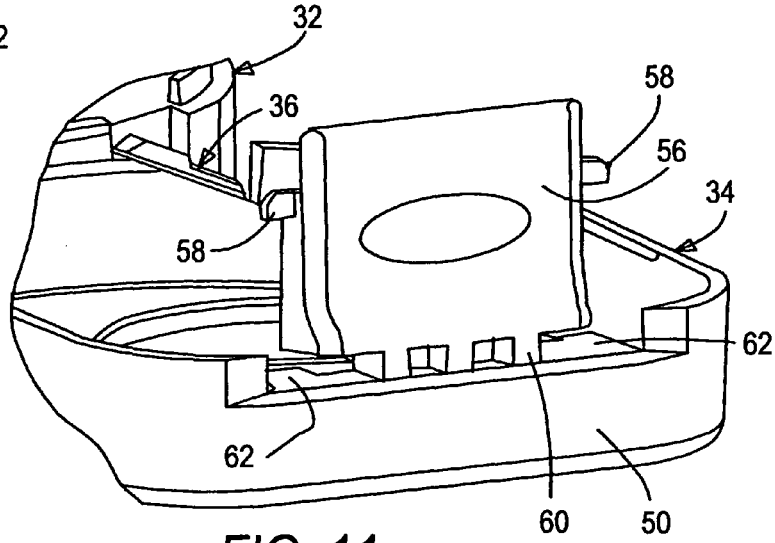
FIG. 11 is a fragmentary perspective view taken from the direction 11 in FIG. 7.
Figure 12:
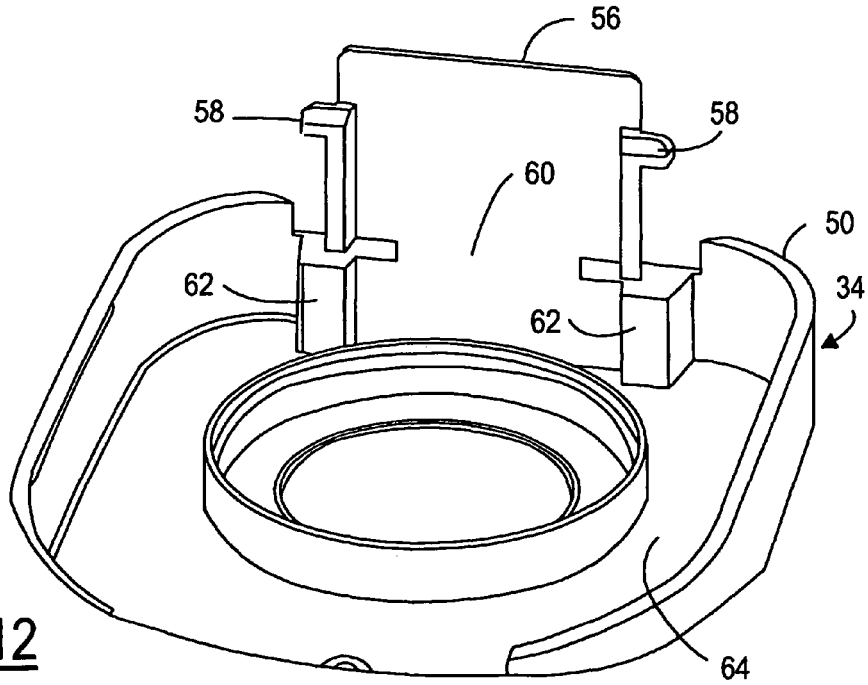
FIG. 12 is a fragmentary perspective view taken from the direction 12 in FIG. 7.

As best seen in FIG. 11, latch arm 56 and hinge strap 60 preferably form a smooth continuation of the outer surface of lid skirt 50, which is to say that latch arm 56 does not form an abrupt change in radial elevation of the skirt surface. As best seen in FIGS. 6, 11 and 12, tabs 58 on latch arm 56 are recessed radially inwardly from the outer surface of latch arm 56. In the same way, ledges 48 in recess 46 are recessed radially inwardly from the outer surface of latch arm 56 in the closed and latched position of the latch arm. In this way, when latch arm 56 is pushed radially inwardly to unlatch the closure lid, the user's finger does not engage ledges 48, which can be uncomfortable for the user. As best seen in FIGS. 1, 3 and 5, recess 46 in base 32 preferably extends to the lower edge of the base so that latch arm 56, when positioned in recess 46, is protected from contact by the shoulder 66 of container body 28.

A child-resistant closure and package thus have been disclosed in conjunction with an exemplary embodiment, and a number of modifications and variations have been discussed. Other modifications and variations readily will suggest themselves to persons of ordinary skill in the art in view of the foregoing description. The disclosure is intended to embrace all such modifications and variations as fall within the spirit and broad scope of the appended claims.

The invention claimed is:

1. A child-resistant dispensing closure that includes:

a base and a lid molded integrally with said base, said lid being coupled by a hinge to said base so as to be pivotable between a closed position and an open position, said lid having a latch arm resiliently extending from a periphery opposite said hinge, said latch arm having a pair of oppositely extending tabs, said base having an external recess for receiving said latch arm and a pair of laterally spaced ledges in said recess for engagement by said tabs to lock said lid in said closed position, said latch arm in said recess being directly manually engageable by a user from a radial direction external to said closure to pivot said latch arm radially inwardly within said recess and release said tabs from said ledges so that said lid can be pivoted toward said open position, said tabs on said latch arm being disposed adjacent to a free end of said latch arm spaced from said lid, said latch arm having a portion adapted to be engaged by a user and disposed between said tabs and said lid, said tabs on said latch arm and said ledges in said recess being recessed radially inwardly from an outer surface of said latch arm in said closed position of said lid with said tabs engaged beneath said ledges, wherein said recess is axially open to a bottom of a sidewall of said base, and said tabs on said latch arm engage said ledges adjacent to said bottom of said closure sidewall when said lid is in said closed position.

2. The closure set forth in claim 1 wherein said latch arm has a width adjacent to said lid, and wherein said latch arm is resiliently connected said lid by a flexible hinge strap having a width less than that of said latch arm adjacent to said lid.

3. The closure set forth in claim 1 wherein said lid has a peripheral skirt, said latch arm being coupled to said peripheral skirt of said lid.

4. The closure set forth in claim 3 wherein said lid skirt has an outer surface, and said latch arm has an outer surface that is a smooth continuation of said outer surface of said lid skirt.

5. The closure set forth in claim 3 wherein said latch arm is coupled to said lid skirt by a hinge strap having a width that is less than that of said latch arm adjacent to said lid skirt.

6. The closure set forth in claim 5 wherein said lid includes at least one internal reinforcing rib on said skirt adjacent to said hinge strap.

7. The closure set forth in claim 6 wherein said lid includes a pair of internal reinforcing ribs on said skirt on respective opposite sides of said hinge strap.

8. A child-resistant closure that includes:

a base and a lid integrally molded with said base, said lid being coupled by a base hinge to said base to be pivotable between a closed position and an open position, said lid having a latch arm resiliently extending from a periphery of said lid opposite said hinge, said latch arm having a pair of oppositely extending tabs adjacent to a free end of said latch arm, said base having an external recess for receiving said latch arm and a pair of laterally spaced ledges in said recess for engagement by said tabs to lock said lid in said closed position, said latch arm being directly manually engageable by a user from a radial direction external to said closure to pivot said latch arm radially inwardly within said recess and release said tabs from said ledges so that said lid can be pivoted toward said open position, said latch arm being coupled to said lid by a hinge strap having a width that is less than that of said latch arm adjacent to said lid, wherein said tabs on said latch arm engage said ledges in said recess in said closed position adjacent to a bottom of a sidewall of said closure.

9. The closure set forth in claim 8 wherein said lid has a skirt to which said latch arm is coupled by said hinge strap, and wherein said lid includes at least one internal reinforcing rib on said lid skirt adjacent to said hinge strap.

10. The closure set forth in claim 9 wherein said lid includes a pair of internal reinforcing ribs on said skirt on respective opposite sides of said hinge strap.

11. The closure set forth in claim 9 wherein said lid skirt has an outer surface, and said latch arm has an outer surface that is a smooth continuation of said outer surface of said lid skirt.

12. A child-resistant package that includes:

a container having a neck finish and a closure secured to said container neck finish, said closure including:

a base and a lid molded integrally with said base, said lid being coupled by a hinge to said base so as to be pivotable between a closed position and an open position, said lid having a latch arm resiliently extending from a periphery opposite said hinge, said latch arm having a pair of oppositely extending tabs adjacent to a free end of said latch arm, said base having an external recess for receiving said latch arm and a pair of laterally spaced ledges in said recess for engagement by said tabs to lock said lid in said closed position, said latch arm in said recess being directly manually engageable by a user from a radial direction external to said closure to pivot said latch arm radially inwardly within said recess and release said tabs from said ledges so that said lid can be pivoted toward said open position, said tabs on said latch arm being disposed adjacent to a free end of said latch arm spaced from said lid, said latch arm having a portion adapted to be engaged by a user and disposed between said tabs and said lid, said tabs on said latch arm and said ledges in said recess being recessed radially inwardly from an outer surface of said latch arm in said closed position of said lid with said tabs engaged beneath said ledges, wherein said recess is axially open to a bottom of a sidewall of said base, and said tabs on said latch arm engage said ledges adjacent to said bottom of said closure sidewall when said lid is in said closed position.

13. The package set forth in claim 12 wherein said latch arm has a width adjacent to said lid, and wherein said latch arm is resiliently connected to said lid by a flexible hinge strap having a width less than that of said latch arm adjacent to said lid.

14. The package set forth in claim 12 wherein said lid has a peripheral skirt, said latch arm being coupled to said peripheral skirt of said lid.

15. The package set forth in claim 14 wherein said lid skirt has an outer surface, and said latch arm has an outer surface that is a smooth continuation of said outer surface of said lid skirt.

16. The package set forth in claim 14 wherein said latch arm is coupled to said lid skirt by a hinge strap having a width that is less than that of said latch arm adjacent to said lid skirt.

17. The package set forth in claim 16 wherein said lid includes at least one internal reinforcing rib on said skirt adjacent to said hinge strap.

18. The package set forth in claim 17 wherein said lid includes a pair of internal reinforcing ribs on said skirt on respective opposite sides of said hinge strap.

19. A child-resistant package that includes:

a container having a neck finish and a closure secured to said container neck finish, said closure including:

a base and a lid integrally molded with said base, said lid being coupled by a base hinge to said base to be pivotable between a closed position and an open position, said lid having a latch arm resiliently extending from a periphery of said lid opposite said hinge, said latch arm having a pair of oppositely extending tabs adjacent to a free end of said latch arm, said base having an external recess for receiving said latch arm and a pair of laterally spaced ledges in said recess for engagement by said tabs to lock said lid in said closed position, said latch arm being directly manually engageable by a user from a radial direction external to said closure to pivot said latch arm radially inwardly within said recess and release said tabs from said ledges so that said lid can be pivoted toward said open position, said latch arm being coupled to said lid by a hinge strap having a width that is less than that of said latch arm adjacent to said lid, wherein said tabs on said latch arm engage said ledges in said recess in said closed position adjacent to a bottom of a sidewall of said closure so that a bottom of said latch arm is protected by a shoulder on said container.

20. The package set forth in claim 19 wherein said lid skirt has an outer surface, and said latch arm has an outer surface that is a smooth continuation of said outer surface of said lid skirt.

21. The package set forth in claim 19 wherein said lid includes at least one internal reinforcing rib on said skirt adjacent to said hinge strap.

22. The package set forth in claim 21 wherein said lid includes a pair of internal reinforcing ribs on said skirt on respective opposite sides of said hinge strap.

* * * * *